US005145174A

United States Patent [19]

Caramanoff

[11] Patent Number: 5,145,174

[45] Date of Patent: Sep. 8, 1992

[54] NON-VISUAL LABYRINTH PUZZLE "HIDDEN CRAZY MAZE"

[76] Inventor: George C. Caramanoff, 18037 Barlow, Detroit, Mich. 48205

[21] Appl. No.: 651,524

[22] Filed: Feb. 6, 1991

[51] Int. Cl.[5] ..... A63F 7/04

[52] U.S. Cl. ..... 273/109

[58] Field of Search ..... 273/441, 109, 110–116

[56] References Cited

U.S. PATENT DOCUMENTS

| | | | |
|---|---|---|---|
| 277,120 | 5/1883 | Davenport | 273/109 |
| 1,314,898 | 9/1919 | Peck | 273/109 X |
| 1,952,624 | 3/1934 | Inman et al. | 273/109 X |
| 2,318,793 | 5/1943 | Pait | 273/109 |
| 3,406,971 | 10/1968 | Koff | 273/109 |
| 3,787,054 | 1/1974 | Stafford | 273/109 |
| 4,861,036 | 8/1989 | Watanabe | 273/109 X |

FOREIGN PATENT DOCUMENTS

| | | | |
|---|---|---|---|
| 627137 | 10/1961 | Italy | 273/109 |
| 133574 | 10/1919 | United Kingdom | 273/109 |
| 451220 | 7/1936 | United Kingdom | 273/110 |

*Primary Examiner*—Paul E. Shapiro

*Attorney, Agent, or Firm*—Richard L. Miller

[57] ABSTRACT

A puzzle consisting of a ball bearing enclosed in a labyrinthian passageway, section of the passageway being unobscured from view by an opaque screen. A closed loop may be traced through the passageway, a section of the closed loop being obscured by the opaque screen. The object of the puzzle is to maneuver the ball bearing through the visually obscured region of the labyrinth from one end of the unobscured region of the closed loop to the other end. Solution of the puzzle requires the utilization of auditory and tactile information as the ball bearing rolls through the labyrinth and strikes the walls of the passageway. Because visual information is suppressed, negotiation of the labyrinth requires considerable visualization ability and mental dexterity, and allows for the design of challenging labyrinth puzzles with a minimum of bulk.

2 Claims, 1 Drawing Sheet

NON-VISUAL LABYRINTH PUZZLE "HIDDEN CRAZY MAZE"

BACKGROUND OF THE INVENTION

The instant invention relates generally to puzzles, and more particularly to labyrinth puzzles where a movable object slides or rolls through the passages of a labyrinth upon tilting the system. In particular, the invention relates to a portable labyrinth puzzle where visual information is suppressed.

Numerous labyrinth puzzles have been provided in the prior art that are adapted to provide enjoyment for their users. For example, U.S. Pat. Nos. 3,406,971 to Koff; 3,752,480 to Mazuela; and 4,142,724 to Reick all are illustrative of such prior art. While these units may be suitable for the particular purpose to which they address, they would not be as suitable for the purpose of the present invention as hereafter described.

Traditionally, labyrinth puzzles fall into two distinct categories; different sets of mental facilities are utilized depending on the category. Large, walk-through labyrinths generally do not allow the puzzle solver a view of the system of passageways. Discovering the correct path through the labyrinth requires the puzzle solver to mentally visualize the labyrinth i.e. to form a picture of the labyrinth in the "mind's eye." On the other hand, in portable labyrinth toys, the puzzle solver can see the geometry of the labyrinth so mental visualization plays a less important role. To date, portable labyrinth puzzles have not required considerable mental visualization ability. It is to be noted that whereas both types of labyrinth puzzle do not rely on the processing of auditory and tactile information.

Generally, the difficulty of labyrinth puzzles is increased by increasing the geometrical complexity of the labyrinth. A disadvantage of this approach is that either the size and bulk of the system must increase, or the cross-sectional dimensions of the passageways and the overall puzzle, it is difficult to design truly challenging labyrinth toys.

SUMMARY OF THE INVENTION

The present invention provides a portable labyrinth puzzle which must be negotiated without visual guidance. The suppression of visual sensory information allows for the design of challenging labyrinth puzzles with a minimum of bulk. The puzzle solver must rely on auditory and/or tactile information to determine the geometry of the labyrinth and the position of the ball bearing. This emphasis on mental visualization of the labyrinth is unique for portable labyrinth puzzles.

Accordingly, it is an object of this invention to provide challenging puzzles where a movable object is maneuvered through labyrinth by tilting the labyrinth, wherein portions of the labyrinth are obscured from view.

It is another object of this invention to provide a portable labyrinth puzzle which requires considerable mental visualization skill.

It is another object of this invention to provide a labyrinth puzzle where the sensory cues are entirely or predominately auditory and/or tactile.

Furthermore, it is an object of this invention to provide difficult labyrinth puzzles with a minimum of bulk.

These and other objects of the invention will become more apparent and will be better understood with reference to the subsequent detailed description considered in conjunction with the accompanying drawings.

BRIEF DESCRIPTION OF THE DRAWING FIGURES

The figures in the drawings are briefly described as follows.

DESCRIPTION OF THE PREFERRED EMBODIMENT

Figure 1:
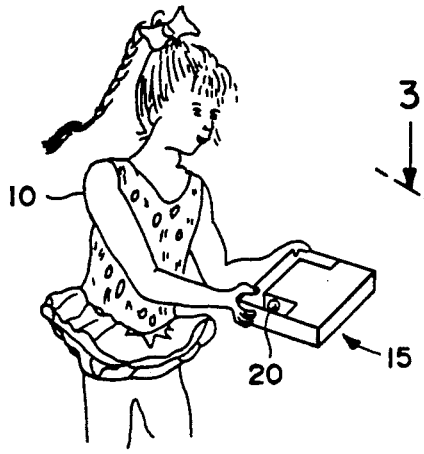
FIG. 1 is a perspective view illustrating a child playing with the instant invention.

FIG. 1 a depicts a child 10 playing with a preferred embodiment of the puzzle 15. The puzzle 15 has a typical dimensions of 7"×7"×⅝". It is to be noted that other dimensions also indicated through out this disclosure are typical and are set forth only so as to illustrate a best embodiment and should not be construed in any way as a limitation.

Figure 2:
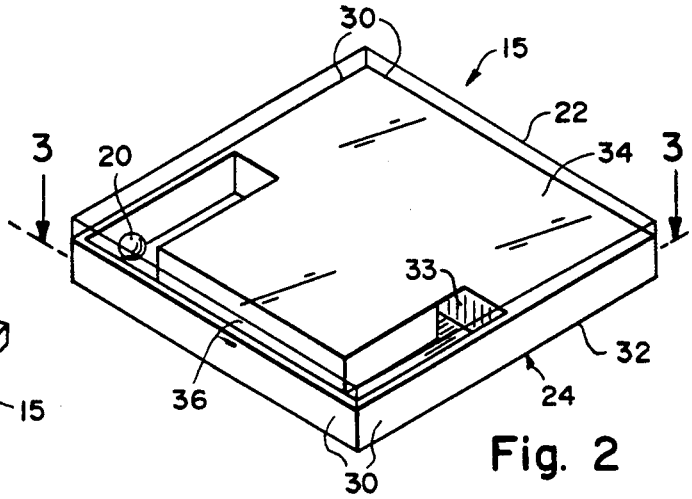
FIG. 2 is an enlarged perspective view of the instant invention per se.

An enlarged view of the puzzle 15 is shown in FIG. 2. A steel ball bearing 20 is enclosed within a transparent top cover 22 and a bottom portion 24 of the puzzle 15. The ball bearing 20 has a diameter of 5/16". All planar sections of the puzzle are made of a sturdy, typically lightweight plastic 1/16" thick. Exterior side walls 30, a bottom wall 32, and an upper screening wall 34 of the bottom portion 24 are opaque. All surfaces are either parallel or perpendicular. The transparent top cover 22 measures 7"×7"×1/16", and is positioned squarely on the bottom portion 24. The top 22 and bottom 24 portions of the puzzle 15 are securely glued together so the ball bearing 20 cannot escape and pose a safety hazard to infants and small children.

Figure 3:
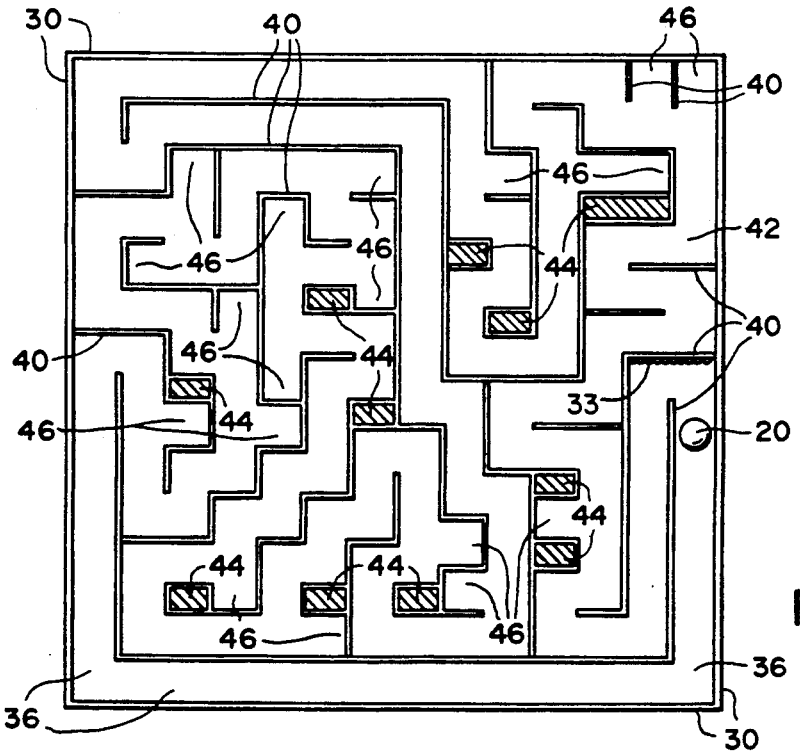
FIG. 3 is a cross sectional view taken on Line 3—3 of FIG. 2.

FIG. 3 shows a cross-section of the puzzle 15. A complex system of interior walls 40 forms a circuitous, branched passageway 42 from one end of the return rack 36 to the other. The interior walls are made of the same sturdy, typical lightweight plastic as the exterior walls 30, 32 and 34 of the bottom portion 24 of the puzzle 15. The exterior side walls 30 and the interior walls 40 are 7/16" high and extend from the bottom wall 32 to the top wall 34. The midplanes of adjacent, parallel interior walls 40 are separated by ½". The midplanes of the side walls 30 are separated ½" from adjacent, parallel interior walls 40. Therefore, the passageway 42 has a square cross-section of 7/16"×7/16" and the ball bearing 20 may roll freely through the labyrinth. Shaded regions are inaccessible to the ball bearing 20. Numerous blind passages 46, or "traps", add to the geometrical complexity of the passageway 42. A long, circuitous closed path may be traced through the system of passageways 42. The position of the ball bearing 20 is manipulated by tilting the puzzle 15. When the ball 20 strikes a plastic wall 30 or 40, the impact can be felt and heard, and information concerning the position of the ball 20 and the geometry of the system of interior walls 40 may be thereby determined.

As shown in FIG. 2, the screening wall 34 shields all of the labyrinth, except a U-shaped return rack 36 from view. The object of the puzzle 15 is to introduce the ball 20 into the region hidden from sight by the screening wall 34 from one end of the return rack 36, and through a series of inclinations of the puzzle 15, to bring the ball 20 into the return rack 36 from the other end. Of course the puzzle 15 can be attempted starting from either end of the return rack 36. The puzzle 15 can also be used as a competitive game between two or more players by measuring the time it takes each competitor to solve the puzzle 15.

The passageway 42 depicted in cross-section in FIG. 3 has numerous branches. The traps 46 in the passageway 42 are short in comparison to typical lengths of blind alleys in mazes which are meant to be constructed in the user's mine but not actually seen while being negotiated. While passageway 42 is trivial to negotiate visually, solution of the puzzle 15 described above requires considerable mental effort.

Thus it is seen that the embodiment presented herein, consistent with the objects of the invention for the non-visual labyrinth puzzle, produces a challenging portable labyrinth puzzle, which requires considerable mental visualization ability and mental dexterity to negotiate, in which auditory and/or tactile cues are very useful while still having very little bulk.

While the above description contains many specifications, these should not be construed as limitations on the scope of the invention, but rather as exemplifications of preferred embodiments thereof. Many other variations are be different; the opaque screening wall 34 may be of a different shape or may have apertures providing visual information as to the geometry of the passageway 42 and the location of the ball bearing 20; the bottom wall 32 may be transparent or translucent allowing the puzzle solver to look through the bottom wall 32 for "hints"; the ball bearing 20 may be moved through the passages 42 by means other than tilting the puzzle 15; the object which is moved through the passageway 42 need not be spherical and may slide, instead of roll; the side 30 and interior wall 40, for example, as indicated by reference 33 may be cushioned to suppress auditory information; the ball bearing 20 may be smaller, or made of a material of lighter weight to suppress tactile information; the passageway 42 may be filled with a material more viscous than air to slow the motion of the ball bearing 20; the ball bearing 20 and passageway system 42 may be replaced by any system where a movable object is constrained to a circuitous, branched path; the geometry of the passageway 42 may be three-dimensional; the complex three-dimensional configuration of the passageway 42 may obscure the geometry of the passageway 42 although the walls of the passageway are transparent or translucent; the geometry of the passageway 42 may be visually apparent although sections of the walls are opaque so as to obscure the position of the ball bearing 20.

Accordingly, the scope of the invention should be determined not by the embodiments illustrated, but by the appended claims and their legal equivalents.

Having thus described the invention, what is desired to be protected by Letters Patent is presented by the following appended claims.

What is claimed is:

1. A child's recreational device comprising:

a) a labyrinth path defined by opposite walls of a passageway of substantially constant width;

b) a moveable spherical member constrained to, and moveable along, said path by tilting said recreational device;

c) a substantially opaque screen, said screen obscuring a view of a portion of said path, whereby said moveable member cannot be guided through said obscured portion using visual information; and d) the obscured portion of the path having blind-ended traps defined between further wall portions and communicating with said passageway, and wall portions being cushioned for suppressing sound of the spherical member impacting therewith.

2. The recreational device of claim 1, wherein a portion of said labyrinth path forms a closed loop, and wherein a view of a section of said closed loop is not obscured by said opaque screen, whereby said unobscured section of closed loop is used to determine the progress of said movable member.

* * * * *